US006763627B1

(12) United States Patent
Kaempe

(10) Patent No.: US 6,763,627 B1
(45) Date of Patent: Jul. 20, 2004

(54) BIPOD FOR LIGHT-WEIGHT MACHINE GUN

(76) Inventor: Tonny Kaempe, 242 Chimney Ridge Dr., Columbia, SC (US) 29229

( * ) Notice: Subject to any disclaimer, the term of this patent is extended or adjusted under 35 U.S.C. 154(b) by 0 days.

(21) Appl. No.: 10/621,063

(22) Filed: Jul. 16, 2003

(51) Int. Cl.[7] ..... F41C 29/00
(52) U.S. Cl. ..... 42/94; 89/37.04
(58) Field of Search ..... D22/108; 89/37.04; 248/176.1, 176.3, 188; 42/94

(56) References Cited

U.S. PATENT DOCUMENTS

| | | | | | |
|---|---|---|---|---|---|
| 1,524,973 | A | * | 2/1925 | Hazelton | 42/94 |
| 1,890,423 | A | | 12/1932 | Teagarden | |
| 2,436,349 | A | * | 2/1948 | Adams | 42/94 |
| 2,807,904 | A | * | 10/1957 | Kreske | 42/94 |
| 3,235,997 | A | * | 2/1966 | Stoner | 42/94 |
| 3,235,998 | A | | 2/1966 | Hadley | |
| 4,351,224 | A | * | 9/1982 | Curtis | 89/37.04 |
| 4,397,112 | A | | 8/1983 | York | |
| 4,470,216 | A | * | 9/1984 | Harris | 42/85 |
| 4,607,561 | A | * | 8/1986 | Frimer | 89/37.04 |
| 4,625,620 | A | * | 12/1986 | Harris | 89/37.04 |
| 4,776,124 | A | * | 10/1988 | Clifton | 42/94 |
| 4,787,290 | A | * | 11/1988 | Argon | 89/37.05 |
| 5,074,188 | A | | 12/1991 | Harris | |
| 5,194,678 | A | * | 3/1993 | Kramer | 42/94 |
| 5,711,103 | A | * | 1/1998 | Keng | 42/94 |
| 5,815,974 | A | * | 10/1998 | Keng | 42/94 |
| 5,852,892 | A | | 12/1998 | Bilgeri et al. | |
| 6,289,622 | B1 | * | 9/2001 | Desch et al. | 42/94 |
| 6,517,133 | B2 | * | 2/2003 | Seegmiller et al. | 294/139 |

FOREIGN PATENT DOCUMENTS

| | | |
|---|---|---|
| EP | 0127193 | * 12/1984 |

* cited by examiner

*Primary Examiner*—Michael J. Carone
*Assistant Examiner*—Troy Chambers
(74) *Attorney, Agent, or Firm*—Michael A. Mann; Nexsen Pruet Adams Kleemeier, LLC

(57) ABSTRACT

A bipod for a light-weight machine gun is disclosed. The bipod has tubular telescoping legs that may be extended and retracted to discreet locking positions. The bipod has a spring-based system that allows a user to fold the bipod either towards or away from the barrel muzzle with one hand, thus giving 180 degrees of travel. The spring system also provides a detent to retain the bipod in the folded or deployed position without additional fasteners or catches. The bipod is attachable to a machine gun with a round yoke that allows the user to pivot the direction of fire and rotate the barrel of the machine gun radially while keeping the bipod firmly planted.

17 Claims, 6 Drawing Sheets

BIPOD FOR LIGHT-WEIGHT MACHINE GUN

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The present invention relates to firearms, and specifically to bipods for use with a light-weight machine gun. A machine gun is not a shoulder-fired weapon like a rifle. It may be fired from the hip but is best fired when supported at the muzzle end by a bipod or other structure. Machine guns are heavy, they become quite hot when fired, and the forces associated with rapid firing makes it difficult to maintain accurate targeting unless the muzzle end is property supported.

A bipod has been a staple accessory for many military firearms since the beginning of firearm development. The bipod generally cradles the barrel of a firearm and has two legs that can be planted on the ground. The bipod provides stability and support for the weapon when fired, especially when fired in long bursts.

To be effective, a machine gun must be highly mobile and rapidly deployable. The light-weight machine gun with its bipod must be capable of being removed from one position, carried in a variety of transportation vehicles (e.g. personnel carriers, airplanes, open trucks, etc) to another position, and set up quickly, and the attached bipod should not interfere with that redepolyment. A bipod must also meet other common military objectives such as low weight, ease of use, simple construction, low cost, and high durability.

The twentieth century advent of the light-weight machine gun and the mechanized military has led to a refinement in the state of the art of bipods. Far from just a simple inverted V, current bipods are more complicated devices that include telescoping legs, swivel mounts, and folding structures. For example, U.S. Pat. No. 4,351,224, issued to Curtis, teaches a pair of L-shaped channels that telescope and fold from a deployed position to a stowed position. The bipod only allows for one direction of leg travel and each leg must be folded individually. U.S. Pat. No. 4,625,620, issued to Harris, teaches a pair of telescoping tubular legs that are individually folded and adjusted. In U.S. Pat. No. 5,711,103, issued to Keng, a swivel mount to incorporated into a bipod that allows a gunner to aim the weapon while keeping the bipod stationary. Keng also teaches a pair of telescoping tubular legs that are frictionally locked.

The prior art of firearm bipods, while extensive, is not without shortcomings. Many of the designs have many parts. One significant drawback to the prior art is that the bipod legs must be deployed separately, i.e. the legs must be unfolded one at a time rather than with a single motion. This means the user must either make two separate motions, or must set the gun down and unfold the legs with both hands. The releasing mechanisms that allow the legs to telescope and fold, such as the one disclosed by Curtis, are often overly complex, unreliable, or create a device that is somewhat unwieldy when transported in a small vehicle. Many of the designs, such as the one employing tubular legs with frictional locks as disclosed by Keng, are not suitable for military applications because they are not suitable for combat; dirt or damage to the legs can interfere with the telescoping. Therefore an improved bipod is needed that will be more robust, and easier and quicker to use than prior art bipods.

SUMMARY OF THE INVENTION

Briefly recited and according to its major aspects, the present invention is a bipod for a firearm such as a light-weight machine gun in which the telescoping legs can be deployed with one hand. The present invention has two legs that are connected by spring-based system that allows the legs to be deployed from a stowed position by applying pressure to just one leg. The legs of the present bipod may be stored facing either towards the stock of the gun or towards the muzzle.

When the legs are folded to a deployed position, the spring-based system acts against the legs, causing them to deploy. The spring-based system is housed inside a body that supports a yoke cradling the barrel of the gun in such a way that the gun and its yoke can be rotated radially and axially through a small angle with respect to the body.

Each leg can telescope incrementally between a minimum length and a maximum length, using spring-loaded buttons to lock the legs in place once the desired length is reached. However, because of the design of the buttons, the user can extend the legs simply by pulling on the end of the leg.

An important feature of the present invention is the spring-based system for deploying the legs. Simply rotating one leg from either stored position, pointing forward or rearward, to a direction roughly perpendicular to the stored position, cause the other leg to follow and, when rotated far enough, to spring to the deployed position where the legs are splayed instead of parallel. This feature allows very rapid deployment of the bipod with one band.

Another important feature is the telescoping legs that are extended by pulling and are secured in each successive greater length by the buttons. This feature also facilitates rapid deployment, and cooperates with the spring-based system for the overall speed of deployment of the bipod legs in the right length and splayed in minimal time.

Still another feature of the present invention is the design of the body and spring-based system that permits the legs of the bipod to be stored facing the muzzle or the stock end of the machine gun.

Other features and their advantages will be apparent to those skilled in the art of firearm accessory design and fabrication from a careful reading of the Detailed Description of Preferred Embodiments accompanied by the following drawings.

DETAILED DESCRIPTION OF PREFERRED EMBODIMENTS

The preferred embodiment of the present invention is a bipod with telescoping legs that can be deployed with one hand.

Figure 1:
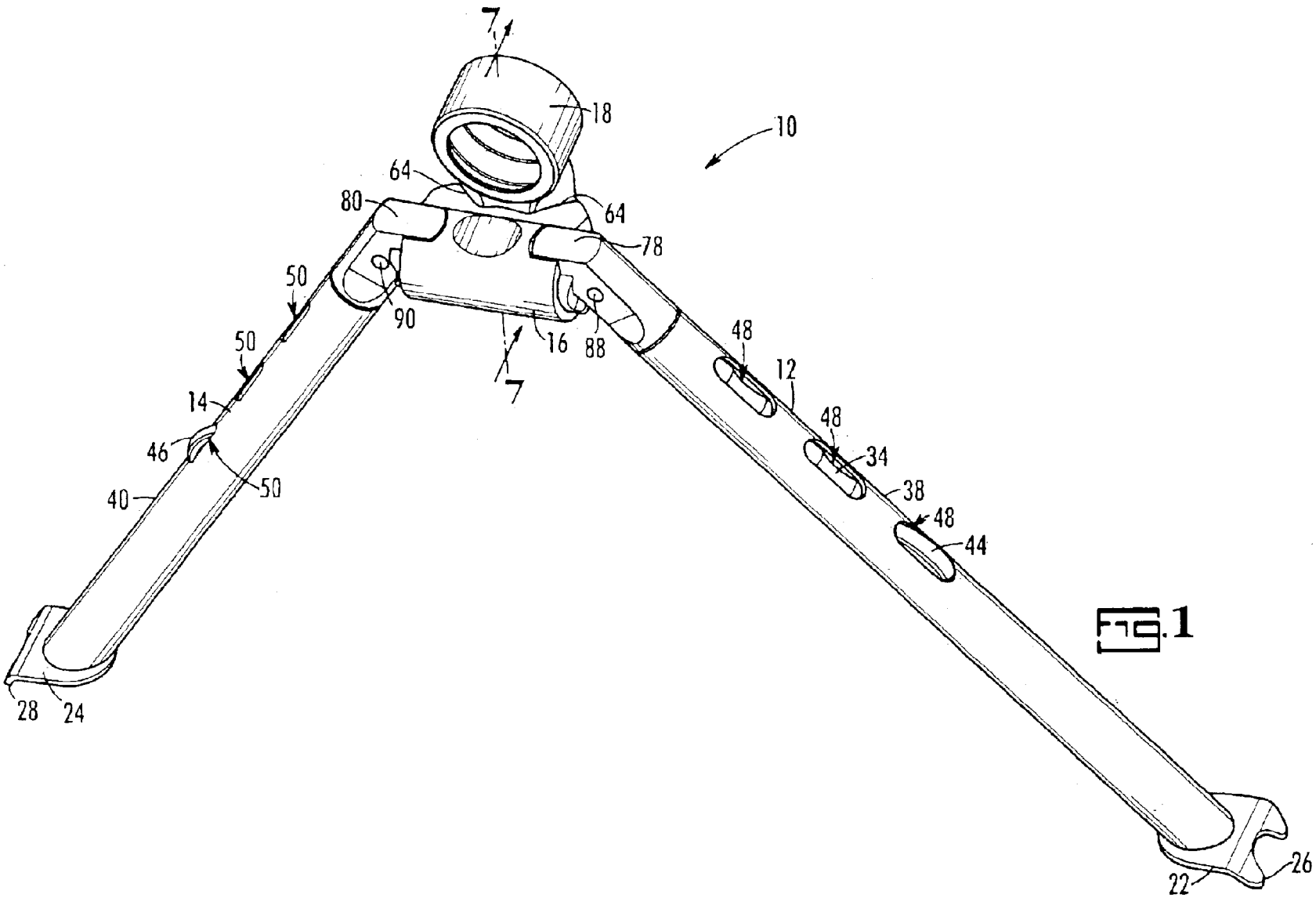
FIG. 1 is a frontal perspective top view of the bipod in the deployed position showing the legs splayed and fully retracted.

Referring now to FIG. 1, there is shown a perspective view of a preferred embodiment of the present invention, namely, a bipod for a light-weight machine gun generally indicated by reference number 10. Bipod 10 has two legs 12 and 14 that are attached to a body 16. Body 16 supports a yoke 18 that is dimensioned for receiving the barrel of a firearm (see FIG. 5) such as a machine gun.

Bipod 10 is shown in the deployed configuration (FIG. 1), with legs 12 and 14 splayed to provide stability. Each leg 12, 14, has a foot 22, 24, respectively, that engages the ground or other surface and is preferably formed to resist lateral movement. Feet 22, 24, have teeth 26, 28, respectively, to bite into a surface such as the ground or a sandbag, for example, and resist lateral movement.

Figure 2:
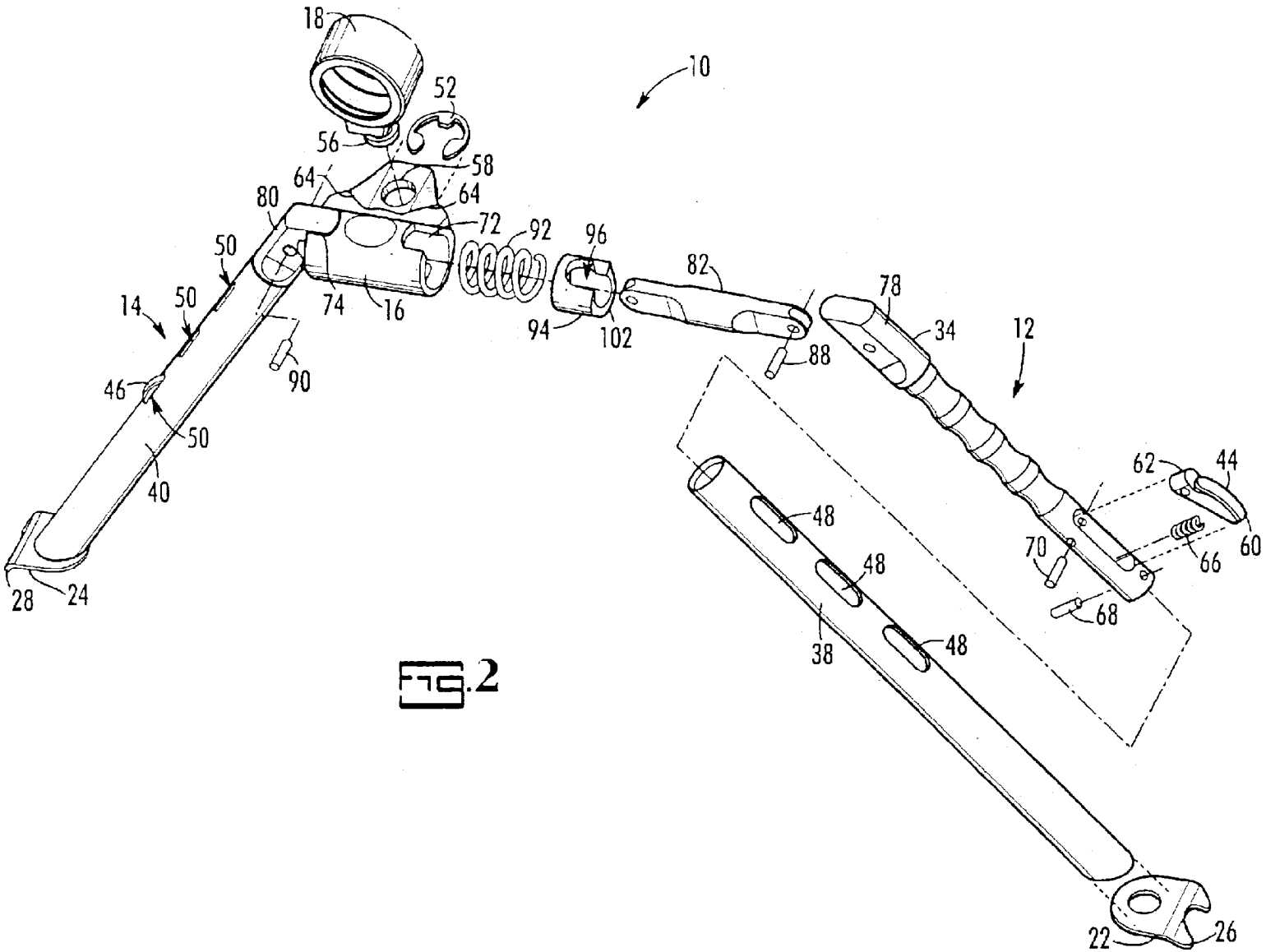
FIG. 2 is an exploded perspective view of the bipod in the deployed position.

Legs 12 and 14 are telescoping, meaning that their lengths can be changed because of nested tubing that slide axially with respect to each other. Here, internal rods 34 and 36 and tubes 38 and 40 provide this telescoping capability (only one rod, rod 34, is shown in FIGS. 1 and 2, but rod 36 is identical to rod 34). In particular rod 34 has an outer diameter that is smaller than the inner diameter of tube 38, and rod 36 has a smaller diameter than inner diameter of tube 40 so that rod 34 can slide axially in and out of tube 38, and rod 36 can slide axially in and out of tube 40. To secure rods 34, 36, with respect to tubes 38 and 40 at various relative positions, rods 34, 36 have spring-loaded, pivoting buttons 44, 46, and tubes 38 and 40 have a series of holes 48, 50, dimensioned to receive buttons 44, 46.

Figures 3A, 3B:
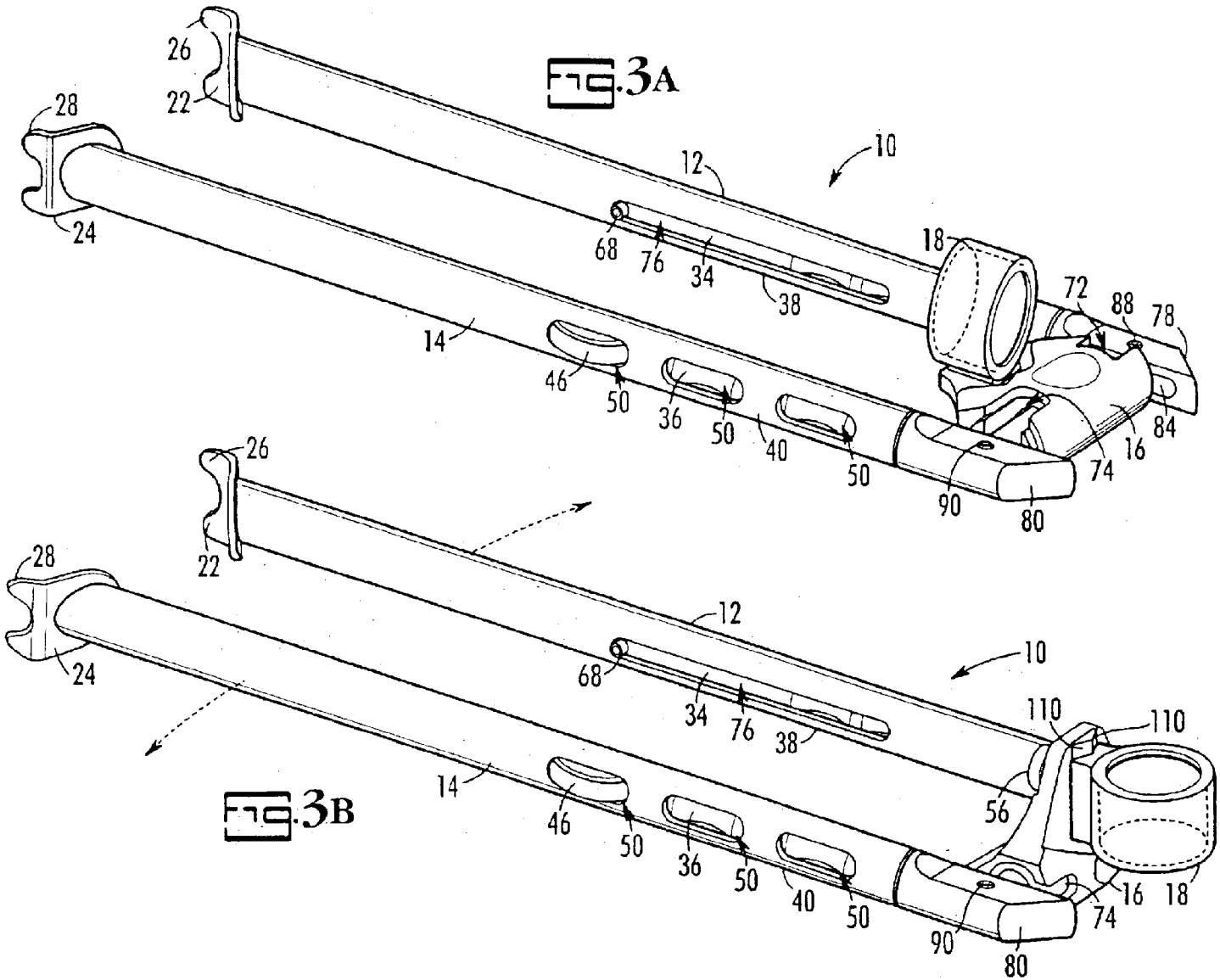
FIG. 3A is a perspective view of the bipod in the stowed position and fully retracted.
FIG. 3B is a perspective view of the bipod in a deployed position with the legs retracted and showing the direction in which the legs are urged by the spring-based system.
Figure 4:
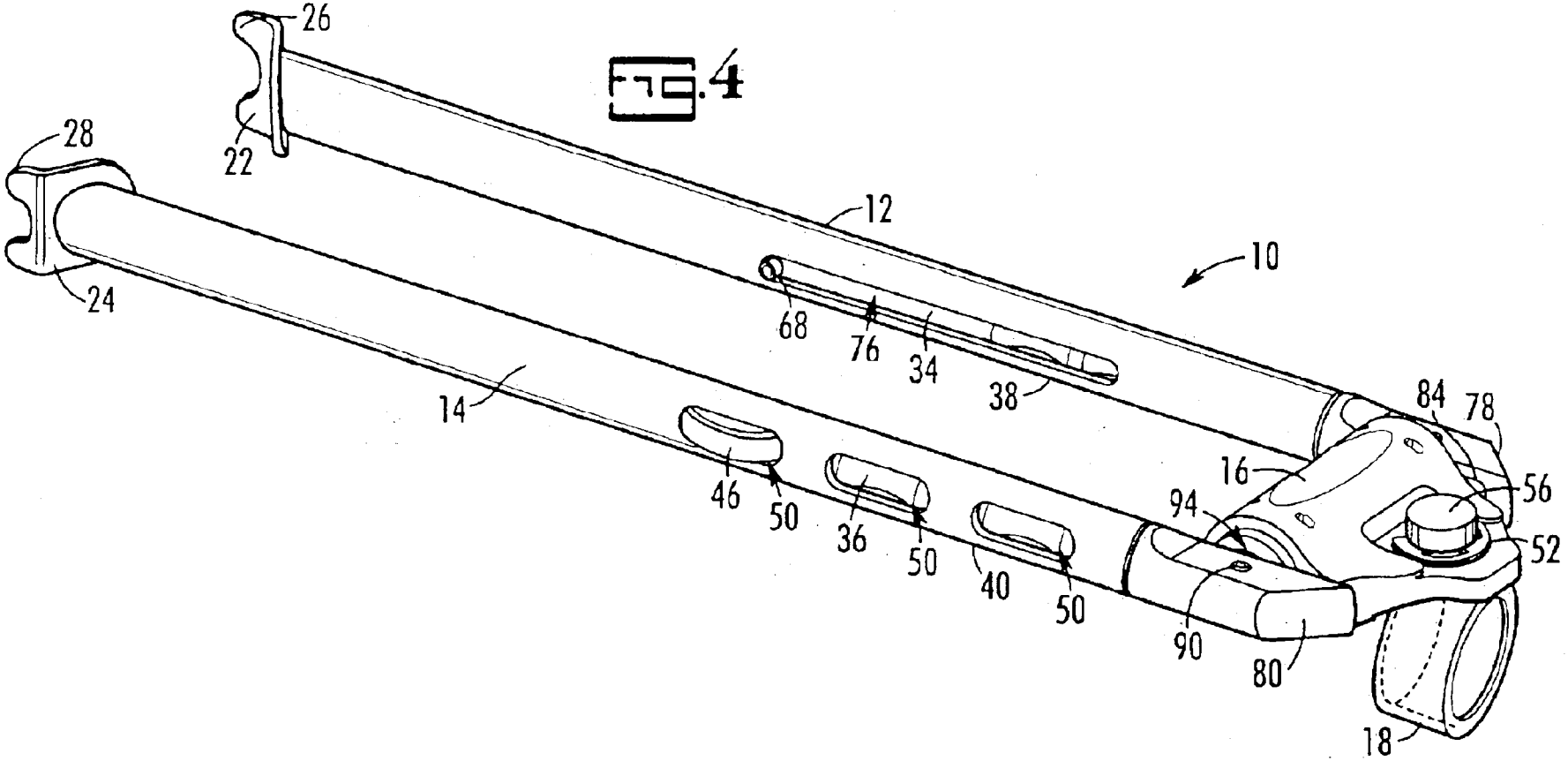
FIG. 4 is a perspective view of the bipod in an alternate stowed position and fully retracted.

Buttons 44, 46 will extend through holes 48, 50, when in rods 34, 36, bring buttons 44, 46, in registration with holes 48, 50, and of tubes 38, 40, and, by doing so, prevent telescopic collapse of legs 12, 14. However, because buttons 44, 46, are spring-loaded and curved, they permit telescopic extension of legs 12, 14, merely by pulling on feet 22, 24. In particular, buttons 44, 46, are oriented to have a major dimension parallel to the long axis of rods 34, 36. Each button 44, 46, has a first end 62 toward body 16 and a second end 60 oriented toward feet 22, 24 (only one button, button 44, is shown exploded in FIG. 2 but button 46 is identical to button 44). Second end 60 is urged outward or away from the axis of rod 34 by a spring 66. First end 62 of button 44 is free to pivot about a pin 70 oriented so that button 44 pivots about an axis perpendicular to the long dimension of rod 34. The surface of buttons 44, 46 is curved so that, when feet 22, 24 are pulled, buttons 44, 46 are crammed inward, toward rods 34, 36, but when feet 22, 24, are pushed toward body 16, buttons 44, 46, will catch on tubes 38, 40 at holes 48, 50, and cannot be pushed further unless pressed inward against rods 34, 36, and held while feet 22, 24 are pushed sufficiently so that buttons 44, 46 go out of registration of holes 48, 50. The maximum and minimum extent of telescoping of rods 34, 36, with respect to tubes 38, 40, is limited by stop pins 68 in slots 76 (FIGS. 3A, 3B, and 4). When stop pin 68 reaches the ends of slot 76, rods 34, 36, are either completely telescopingly extended with respect to tubes 38, 40, or completely telescopingly retracted.

Figure 5:
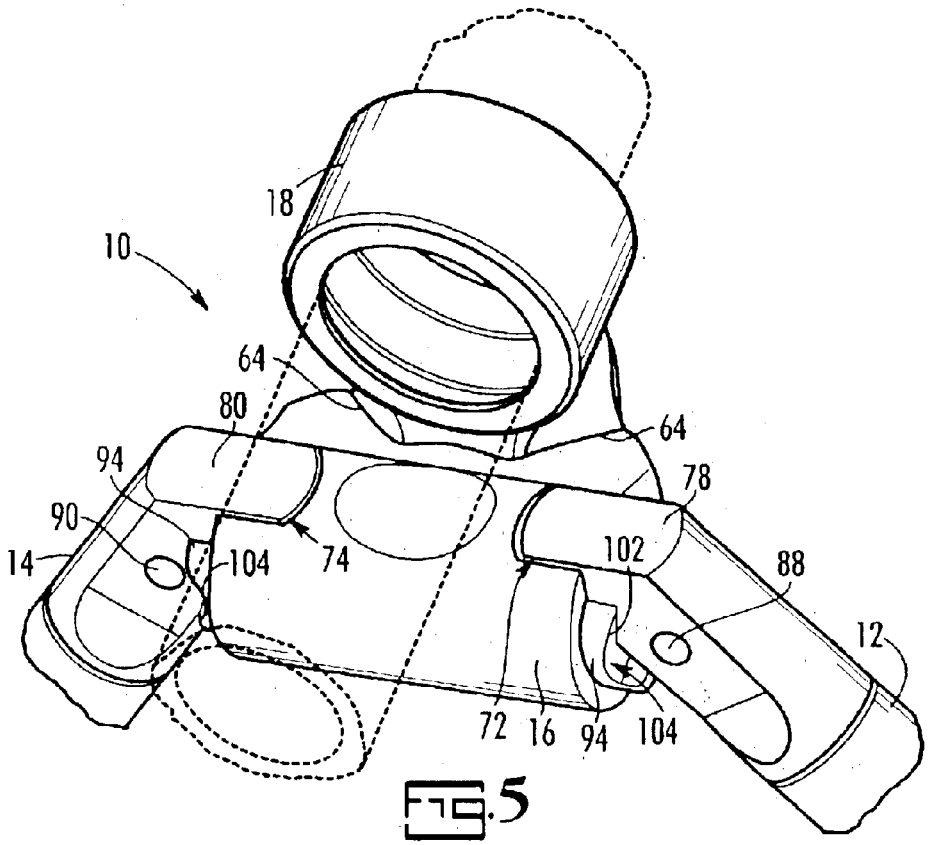
FIG. 5 is a perspective top view of the bipod yoke showing the installation on a firearm barrel (shown by phantom lines)
Figure 6:
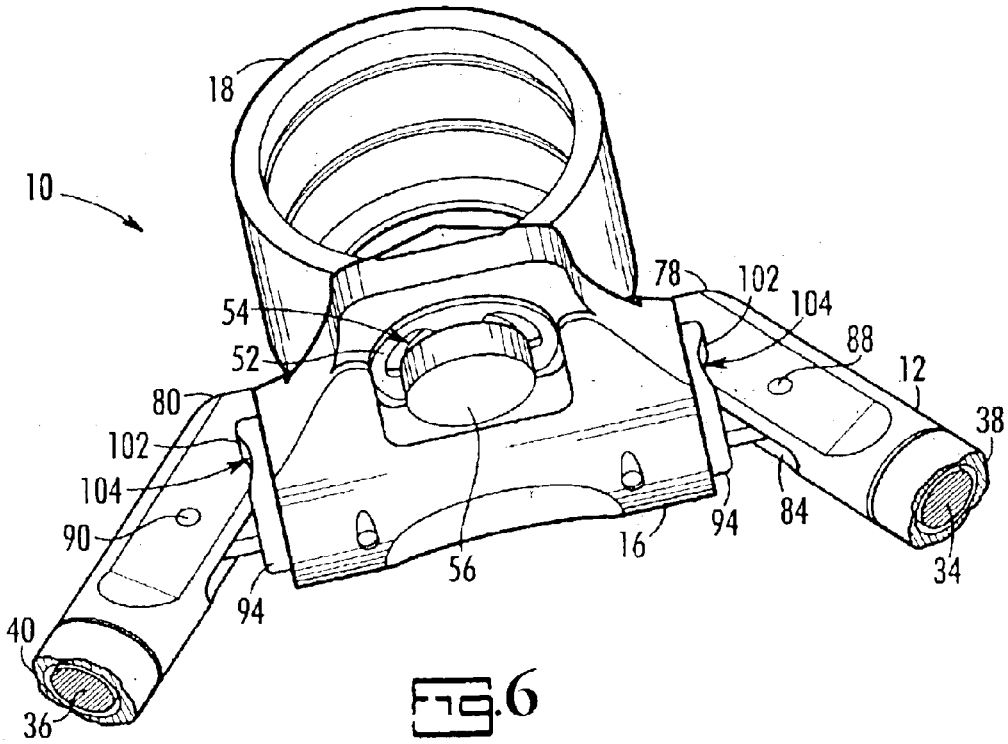
FIG. 6 is a perspective bottom view of the biped yoke.

Referring now to FIGS. 2, 5–8, bipod 10 is attached to a firearm barrel by yoke 18, which is ring-shaped and strong enough to provide durable support, and preferably made of metal or metal alloy. Yoke 18 is attached to a body 16 by a E-clip 52 inserted into a groove 54 in a post 56 of yoke 18 that inserts into a hole 58 of body 16 (shown in FIGS. 6 and 8). The connection is maintained tight enough by E-clip 52 so that yoke 18 will not wobble or vibrate, but is flexible enough to allow yoke 18 to pivot in relation to body 16. Pivoting allows a gunner to rotate the barrel of a gun through a small angle in a plane lying perpendicular to a line bisecting the splayed legs 12, 14, so that the gun carried in yoke 18 has a field of fire. The pivot angle is defined by ledges 64 on body 16 (FIG. 5) that limit the rotation of yoke 18 about post 56 (FIG. 6).

Figure 7:
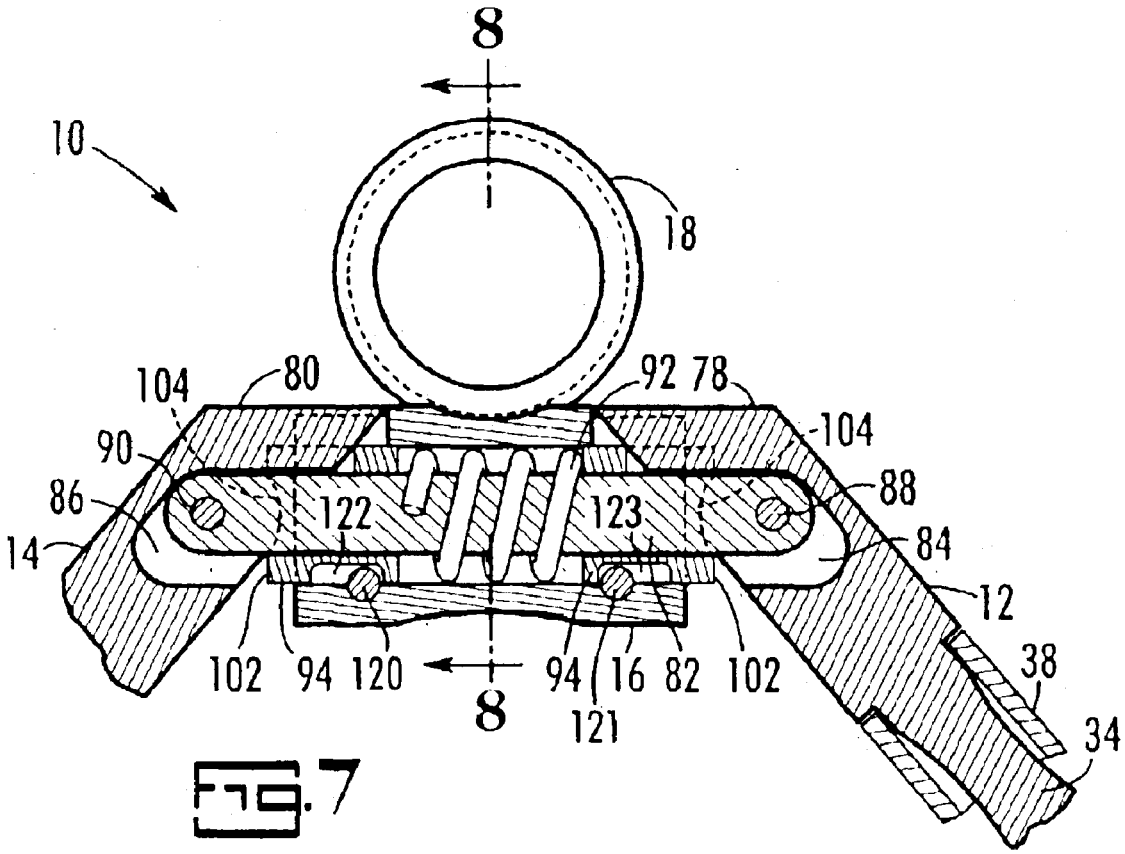
FIG. 7 is a cross-sectional view taken along lines 7—7 of FIG. 1.
Figure 8:
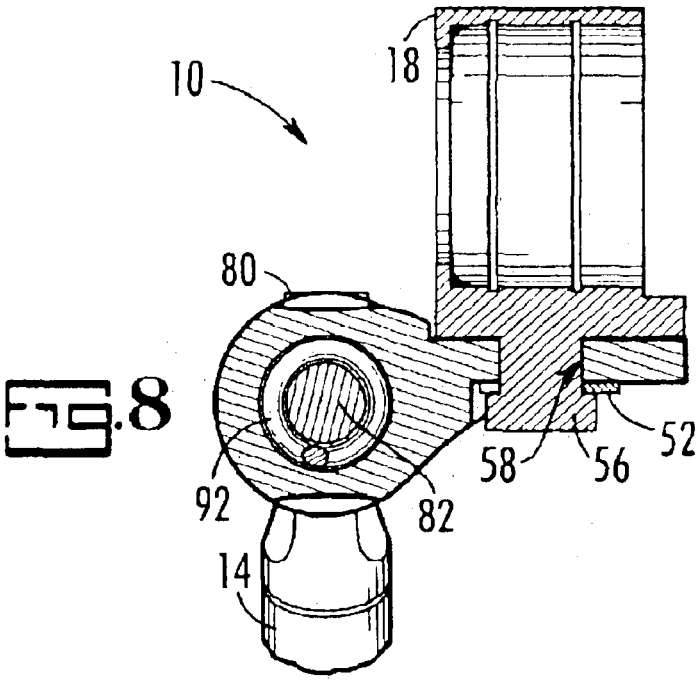
FIG. 8 is a cross-sectional view taken along lines 8—8 of FIG. 7.

Referring in particular to FIGS. 2 and 7, in the preferred embodiment, body 16 is essentially a hollow cylinder open at both ends and having cutout portions 72, 74 for receiving the tops 78, 80, of legs 12, 14, respectively, when legs 12, 14, are splayed. Legs 12, 14, are held securely to body 16 by a tie member 82 that is received within body 16 but which extends far enough beyond the ends of body 16 to allow it to be inserted into slots 84, 86, formed in tops 78, 80, of legs 12, 14, where it is secured with pins 88, 90.

Inside body 16 is a compression spring 92 that encircles tie member 82 and is flanked by two plungers 94 (see FIG. 2 and FIG. 7) each of which is a hollow cylinder and has a cutout portion 96 for receiving tops 78, 80. Compression spring 92 resists the movement of plungers 94 toward each other and urges plungers 94 axially outward of body 16. Each plunger 94 is retained inside body 16 by pins 120, 121, which also limit each plunger 94's motion axially and rotationally through engagement with cuts 122, 123, formed in the bottom of each plunger 94. Cutout portion 96 is alignable with cutout portion 72 so that, when they are aligned, tops 78, 80, will be received in both of them as legs 12, 14, are rotated to a splayed position. When legs 12, 14, are splayed, feet 22, 24, rotate outwardly and tops 78, 80, rotate into cutout portions 72. and 96. The plungers 94 are prevented from rotating by the engagement of pins 120, 121, within cuts 122, 123.

Meanwhile plungers 94, urged by compression spring 92, urges legs 12, 14, to the splayed, deployed position whenever legs 12, 14, are rotated from either of two stored positions. Plungers 94 accomplish this by the engagement of their leading edges 102 against legs 12, 14, at points just below where pins 88, 90, connect tie member 82 to legs 12, 14. By applying pressure at that point, leading edges 102 of plungers 94 cause legs 12, 14, to pivot about pins 88, 90, to move tops 78, 80, into cutout portions 72, 96, but only when legs 12, 14, have been rotated to the point where tops 78, 80 are able to be received within the aligned cutout portions 72, 74, i.e., to the position where they are to be deployed.

When legs 12, 14, have been rotated to either stowed position, tops 78, 80, will not be aligned for receipt into cutout portions 72, 96, and no rotation of legs 12, 14, can take place. In fact, when bipod 10 is in either stored position, leading edge 102 of plunger 94 will be engaging legs 12, 14, both above and below pins 88, 90 so no rotation will take place. Preferably, leading edge 102 of each plunger 94 has a pair of concave curves 104 formed on it (best seen in FIGS. 5, 6, and 7) so that legs 12, 14, are preferentially urged into the two stored positions (which will be described in more detail below).

FIGS. 3A, 3B, and 4 illustrate the three positions of bipod 10. FIG. 3A shows bipod in a stored position with the axis of yoke 18 parallel to the axes of legs 12, 14. When mounted onto the barrel of a machine gun or other gun in the configuration shown in FIG. 3A with barrel pointed to the right, legs 12, 14, extend rearward relative to the muzzle end of the barrel and aligned parallel to the barrel.

FIG. 3B illustrates bipod 10 with legs 12, 14 oriented with respect to yoke 18 so that legs 12, 14 will spring into the deployed position in which they are splayed, as indicated by the arrows in FIG. 3B, and perpendicular to that of their stored position, as shown in FIG. 5.

FIG. 4 illustrates bipod 10 with yoke 18 oriented in the second of two stored positions. When bipod 10 is mounted to the barrel of a gun so that the barrel is pointed to the left, legs 12, 14, will extend away from but again parallel to the barrel. The machine gun is able to fire when legs 12, 14, are in any of these three orientations.

In use, bipod 10 is mounted to a machine gun and, if not already in one of the two stored positions, is placed in either stored positions by first pushing legs 12, 14, together so that they are parallel. Then legs 12, 14, can be rotated while held in parallel to either the position shown in FIG. 3A or 4 from that shown in FIG. 3B.

To deploy bipod 10, either leg 12, 14, can be grasped and rotated 90° from either stored position. As leg 12 or 14 reaches the 90° point, compression spring 92 will force plungers 94 laterally and push legs 12, 14, outward at feet 22, 24. The user can then grasp either foot 22, 24, of legs, 12, 14, and pull to extend the length of that leg. At intervals along the length of legs 12, 14 as they are being telescopingly extended, buttons 44, 46, on rods 34, 36, will come into registration with holes 48, 50 in tubes 38, 40, so that they will extend through holes 48, 50. If feet 22, 24, are pulled farther, buttons 44, 46, will be crammed against rods 34, 36, by tubes 38, 40, to allowed additional length, until the desired lengths for legs 12, 14, are reached and buttons 44,46, have again come into registration with another set of holes 48, 50.

Once bipod 10 is in the deployed position, the machine gun on which it is mounted can be placed in position and the gunner can check his or her field of fire by rotating yoke 18 through the angle permitted by ledges 64 on body 16. He can also rotate the machine gun axially through the angle permitted by ledges 110 on yoke 18.

It will be readily apparent to those skilled in the art of firearm accessory design and fabrication that many changes and substitutions can be made to the foregoing preferred embodiments without departing from the spirit and scope of the present invention, defined by the appended claims.

What is claimed is:

1. A bipod for use with a firearm, said bipod comprising:

(a) a hollow body having cutout portions formed therein;

(b) a pair of legs, said pair of legs being attached to said body and having a stored position and a deployed position, said pair of legs being received in said cutout portions of said body when in said deployed position and not received in said cutout portions when in said stored position;

(c) a yoke carried by said body and formed to mount to a firearm barrel; and (d) urging means carried by said body and connecting said legs so that when a first leg of said pair of legs is rotated with respect to said body between said stored and said deployed positions, said urging means rotates said second leg with said first leg.

2. The bipod as recited in claim 1, wherein said legs are parallel to a barrel of a gun, when said yoke is mounted to the barrel of a gun and said legs are in said stored position, and, when said legs are rotated from said stored position to said deployed position, said urging means splays said legs.

3. The bipod as recited in claim 1, wherein said legs have a first stored position and a second stored position, said legs being aligned parallel to a barrel of a gun when said yoke is mounted to said barrel of a gun and said legs are in said first and said second stored positions, said first stored position being oriented approximately 180° from said second stored position.

4. The bipod as recited in claim 1, wherein said urging means further comprises a compression spring housed in said body and in operational connection with said legs, said compression spring urging said legs to splay when said legs are rotated into said deployed position.

5. The bipod as recited in claim 1, wherein said pair of legs are telescoping.

6. The bipod as recited in claim 5, wherein each leg of said pair of legs has means carried therein for permitting said legs to be telescopingly extended by pulling on said each leg.

7. The bipod as recited in claim 6, wherein said each leg carries a spring-loaded button that must be pressed to telescopingly collapse said each leg.

8. A bipod for use with a firearm, said bipod comprising:

(a) a hollow body;

(b) a yoke pivotally carried by said body and formed to mount to a firearm barrel;

(c) a first leg having a first end and an opposing second end;

(d) a second leg having a first end and a second end, said first and said second legs having a stored position and a deployed position;

(e) means carried by said body for connecting said first leg to said second leg so that rotation of said first leg rotates said second leg; and (f) urging means carried by said body and in operational connection with said legs so that when a first leg is rotated with respect to said body from said stored to said deployed positions, said urging means splays said first and said second legs, said urging means including a compression spring and two hollow plungers, said compression spring and said two plungers being carried within said body, said compression spring being positioned between said two hollow plungers, whereby said plungers, urged by said compression spring, will deploy said first and said second legs when said first and second legs are rotated from said stored position.

9. The bipod as recited in claim 8, wherein said body includes ledges for limiting pivoting of said yoke with respect to said body.

10. The bipod as recited in claim 8, wherein said yoke includes ledges for limiting axial rotation of said firearm with respect to said yoke.

11. The bipod as recited in claim 8, wherein said first and said second legs each carry means for engaging a surface and resisting lateral movement of said bipod with respect to said surface.

12. The bipod as recited in claim 8, wherein said connecting means is a tie element received within said body and pivotally connecting said first end of said first leg to said first end of said second leg.

13. The bipod as recited in claim 8, wherein said connecting means is a tie element received within said body and connected to said first end of said first leg and said first end of said second leg, said tie element being encircled by said compression spring and said plungers.

14. The bipod as recited claim 8, wherein said body has a first end and an opposing second end, said first leg attached to said first end of said body and said second leg attached to said second end of said body, said first and second ends of said body having cutout portions and said two hollow plungers having cutout portions, said first ends of said first and said second legs being received in said cutout portions of said two hollow plungers and said first and second ends of said body when said first and said second legs are in said deployed position.

15. The bipod as recited in claim 13, wherein said two hollow plungers have leading edges, said leading edges being urged by said compression spring into engagement with said first and said second legs.

16. The bipod as recited in claim 15, wherein said leading edges have concave portions to preferentially urge said legs into said stored positions.

17. The bipod as recited in claim 14, further comprising a pair of pins and wherein said body has two holes formed therein dimensioned to receive said pins, and wherein said two hollow plungers have cuts formed therein, said cuts also being dimensioned to receive pins and being aligned with said two holes in said body, said pins being used to limit axial and rotational motion of said hollow plungers.

* * * * *

UNITED STATES PATENT AND TRADEMARK OFFICE

CERTIFICATE OF CORRECTION

PATENT NO. : 6,763,627 B1
APPLICATION NO. : 10/621063
DATED : July 20, 2004
INVENTOR(S) : Tonny Kaempe It is certified that error appears in the above-identified patent and that said Letters Patent is hereby corrected as shown below:

On the Title page (73) add the following:
Assignee: FN Manufacturing, Inc., Columbia, S.C.

Signed and Sealed this

Thirteenth Day of November, 2007

JON W. DUDAS
*Director of the United States Patent and Trademark Office*